US007308870B2

(12) United States Patent
Hada et al.

(10) Patent No.: US 7,308,870 B2
(45) Date of Patent: Dec. 18, 2007

(54) COOLANT DISTRIBUTING MEANS FOR AN INTERNAL COMBUSTION ENGINE

(75) Inventors: Masatoshi Hada, Nagoya (JP); Takayoshi Ichihara, Fujisawa (JP)

(73) Assignees: Aichi Machine Industry Co., Ltd., Aichi-ken (JP); Nissan Motor Co., Ltd., Kanagawa-ken (JP)

( * ) Notice: Subject to any disclaimer, the term of this patent is extended or adjusted under 35 U.S.C. 154(b) by 142 days.

(21) Appl. No.: 11/203,102

(22) Filed: Aug. 15, 2005

(65) Prior Publication Data

US 2006/0042568 A1 Mar. 2, 2006

(30) Foreign Application Priority Data

Aug. 31, 2004 (JP) ..... 2004-253639

(51) Int. Cl.
*F02P 9/02* (2006.01)

(52) U.S. Cl. ..... 123/41.25; 123/41.26; 123/41.3; 165/283

(58) Field of Classification Search ..... 123/41.01, 123/41.25, 41.21, 41.26, 41.3, 41.51, 41.54, 123/41.57; 165/283
See application file for complete search history.

(56) References Cited

U.S. PATENT DOCUMENTS 3,384,304 A * 5/1968 Barlow ..... 237/8 A
4,491,174 A * 1/1985 Villeval ..... 165/104.32
5,092,282 A * 3/1992 Danekas et al. ..... 123/41.21
5,111,776 A * 5/1992 Matsushiro et al. ..... 123/41.54
5,139,082 A * 8/1992 McEachern, Jr. ..... 165/104.32
5,255,635 A * 10/1993 Schafer et al. ..... 123/41.2
5,385,123 A * 1/1995 Evans ..... 123/41.21

OTHER PUBLICATIONS

Service Manual for Honda Accord, Section: Chassis Maintenance (2002, 10), pp. 5-147, 5-156.

* cited by examiner

*Primary Examiner*—Stephen K. Cronin
(74) *Attorney, Agent, or Firm*—Dennison, Schultz & MacDonald

(57) ABSTRACT

A cooling system for an internal combustion engine in which bubbles are not transferred to the water pump, and thereby the efficiency of the water pump is maintained. The interior of a water outlet mounted on a cylinder head is divided by a partition wall to form a feeding chamber to feed the coolant introduced from the cylinder head to a first path provided with a radiator, and a receiving chamber forming a second path to receive the coolant returned from a heater core. Between the receiving chamber and the feeding chamber is a channel making one or both chambers communicate with the other. As a result, bubbles in the coolant running through the second path are introduced into the feeding chamber through the channel and removed from the radiator.

6 Claims, 4 Drawing Sheets

COOLANT DISTRIBUTING MEANS FOR AN INTERNAL COMBUSTION ENGINE

FIELD OF THE INVENTION

The present invention relates to a cooling system and an internal combustion engine provided with this cooling system.

BACKGROUND OF THE INVENTION

One known arrangement of the cooling system of this type is to perform cooling by circulating the coolant through the cylinder head and cylinder block by means of a water pump driven by the internal combustion engine, as disclosed in the following non-patent document 1, for example. In this cooling system, the coolant after cooling the cylinder head and cylinder block is returned to the water pump through a radiator and a heater, etc. The returned coolant is supplied again to the cylinder head and cylinder block through the water pump.

Non-patent document 1: Service Manual HONDA ACCORD Section: Chassis Maintenance (2002, 10) Page 5-147, 5-156

In such a cooling system, however, when the cylinder head and cylinder block are cooled, part of the coolant is vaporized and the produced bubbles are transferred to the water pump. As a result, air drawing occurs in the water pump and thereby the cooling system is liable to lower the cooling performance.

SUMMARY OF THE INVENTION

The present invention is worked out in view of the above-described problems in the prior art. It is an object of the present invention to provide a cooling system that is capable of removing the bubbles contained in the cooling water or coolant and returning the coolant without the bubbles into a coolant pumping means. The foregoing object is accomplished by a cooling system for performing the cooling of an internal combustion engine by means of circulating coolant. The cooling system includes a coolant pumping means for pumping the coolant; and a coolant returning means for removing bubbles included in the coolant and for returning the coolant without bubbles to the coolant pumping means. Accordingly, in this cooling system, the bubbles are prevented from entering the coolant pumping means, the efficiency of which is prevented from lowering, so that the cooling performance of the cooling system may be improved.

Another object of the present invention is to provide an internal combustion engine having a cooling system that is capable of removing bubbles contained in the coolant and returning the coolant without the bubbles into a coolant pumping means. Accordingly, in this internal combustion engine, the cooling performance of the engine may be improved.

In carrying out the invention in one preferred mode, the coolant returning means is a means for removing bubbles contained in the coolant after cooling the internal combustion engine and for returning the coolant to the coolant pumping means. Accordingly, it is possible to remove the bubbles generated due to vaporization of a part of the coolant while cooling the internal combustion engine.

In another embodied mode of the invention, the coolant returning means has a first path for returning the coolant to the coolant pumping means through a bubble removing portion capable of removing the bubbles, and a second path for returning the coolant to the coolant pumping means not through the bubble removing portion. In the second path is formed a bubble introducing portion capable of introducing the bubbles into the bubble removing portion through the first path. Accordingly, since the bubbles contained in the coolant flowing in the second path may be introduced through the bubble introducing portion into the bubble removing portion in the first path, the coolant containing bubbles may be well prevented from being returned into the coolant pumping means.

In a further embodied mode of the invention, the coolant returning means has a coolant distributing means comprising a feeding chamber for feeding the coolant after cooling the internal combustion engine into the first path and/or the second path; and a receiving chamber provided as a part of the second path under the feeding chamber for receiving the coolant fed into the second path from the feeding chamber and for returning the coolant into the coolant pumping means. The foregoing bubble introducing portion is a means for making the upper portion of the receiving chamber communicate with the feeding chamber. Accordingly, the bubbles within the coolant fed into the second path may be well removed by means of such a simple construction as making the upper portion of the receiving chamber communicate with the feeding chamber.

In a still further embodied mode of the invention, the coolant distributing means has a mating surface with the internal combustion engine; the feeding and the receiving chamber are divided by a partition formed as a part of the mating surface; and the bubble introducing portion is a notch formed in the partition. Accordingly, the bubble introducing portion may be realized in a simple construction such as a notch enabling a reduction in the numbers of parts.

In a still further embodied mode of the invention, the first path is provided with a heat radiating means for radiating the heat of the coolant and the bubble removing portion is formed in the heat radiating means. The bubble removing portion is formed as a cap in the existing radiator, so that it is possible to reduce the numbers of parts.

Other advantageous features of the invention will be obvious after a reading of the following detailed description of the preferred embodiment shown in the drawings as follows.

DESCRIPTION OF THE PREFERRED EMBODIMENT

Hereinafter, an embodiment of the present invention will be described with reference to the drawings.

Figure 1:
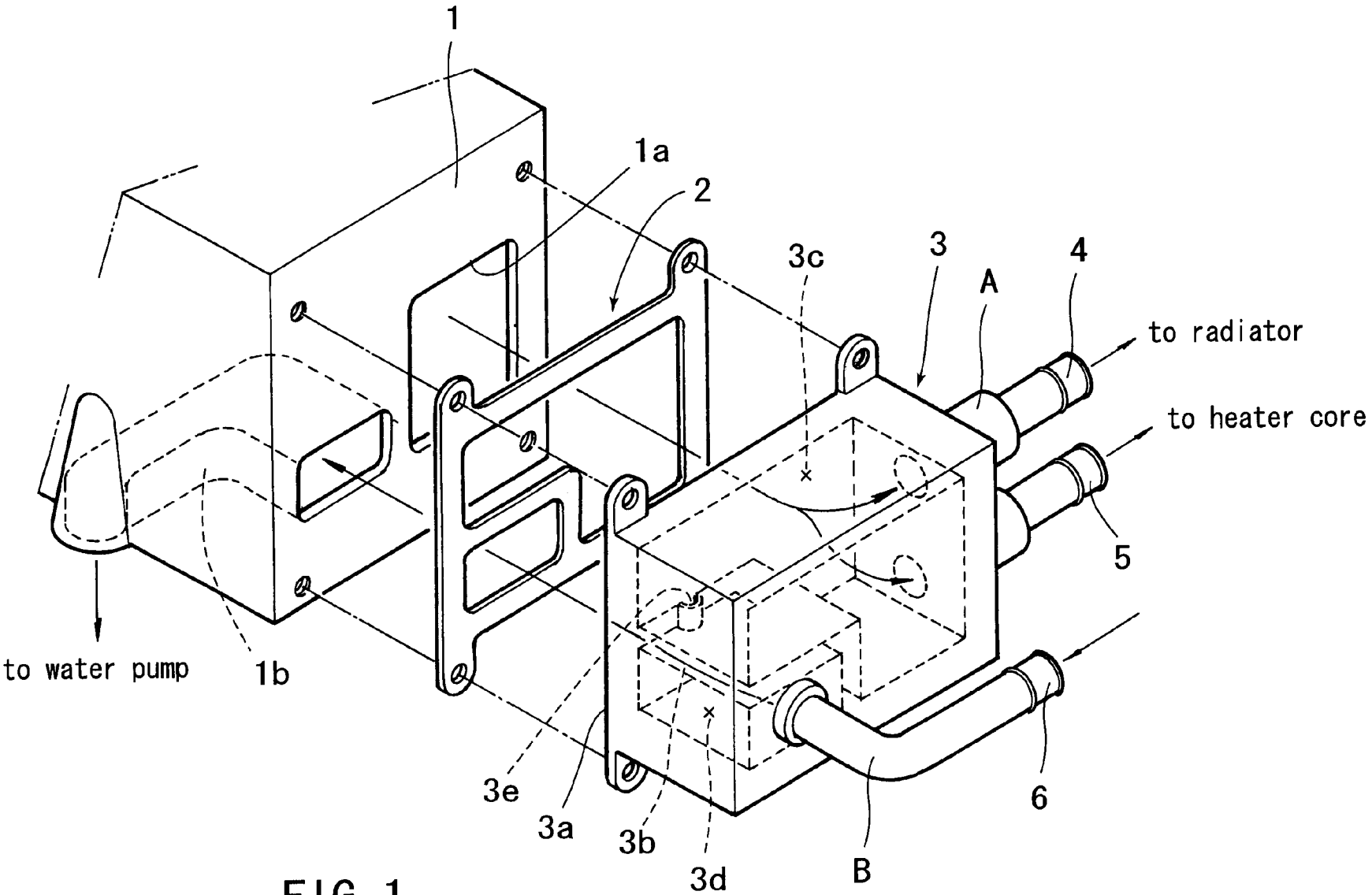
FIG. 1 is an exploded perspective view of a water outlet to be mounted on a cylinder head through a gasket between them, as a first embodiment according to the present invention.
Figure 2:
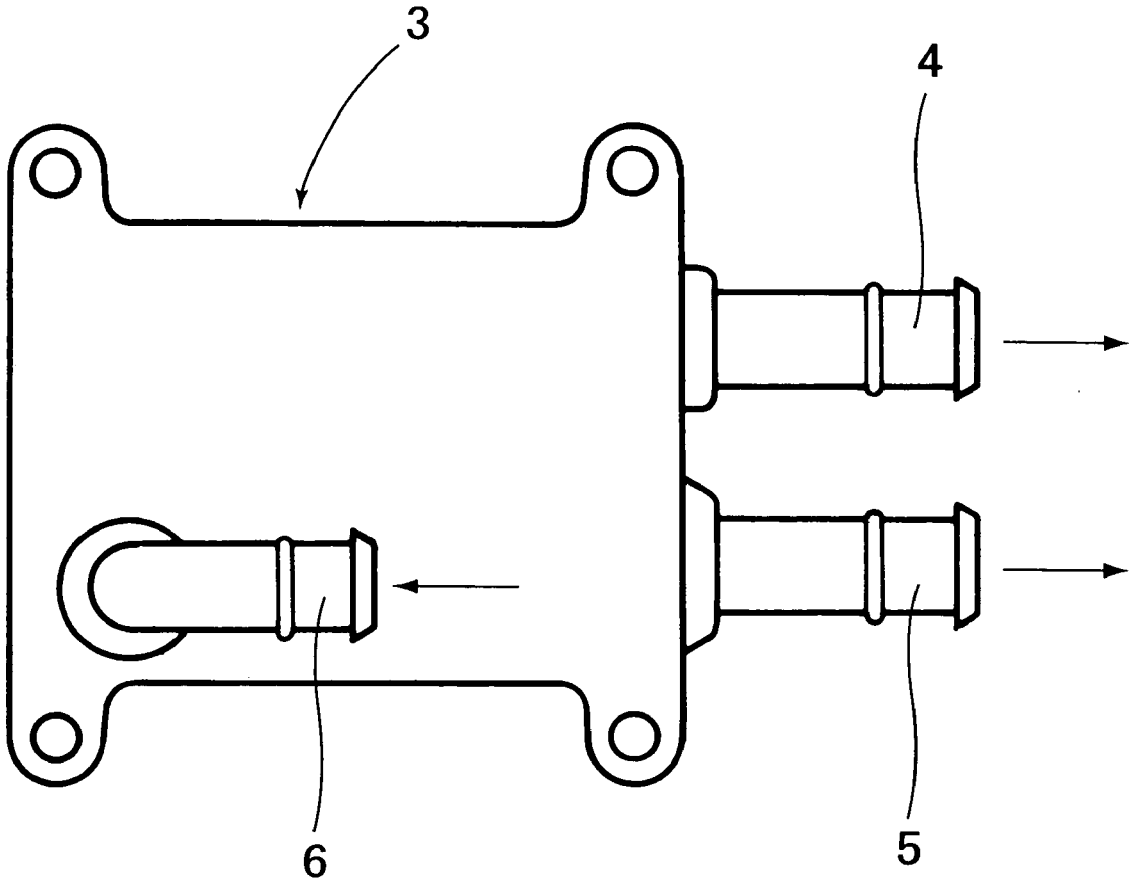
FIG. 2 is a rear view of the water outlet.
Figure 3:
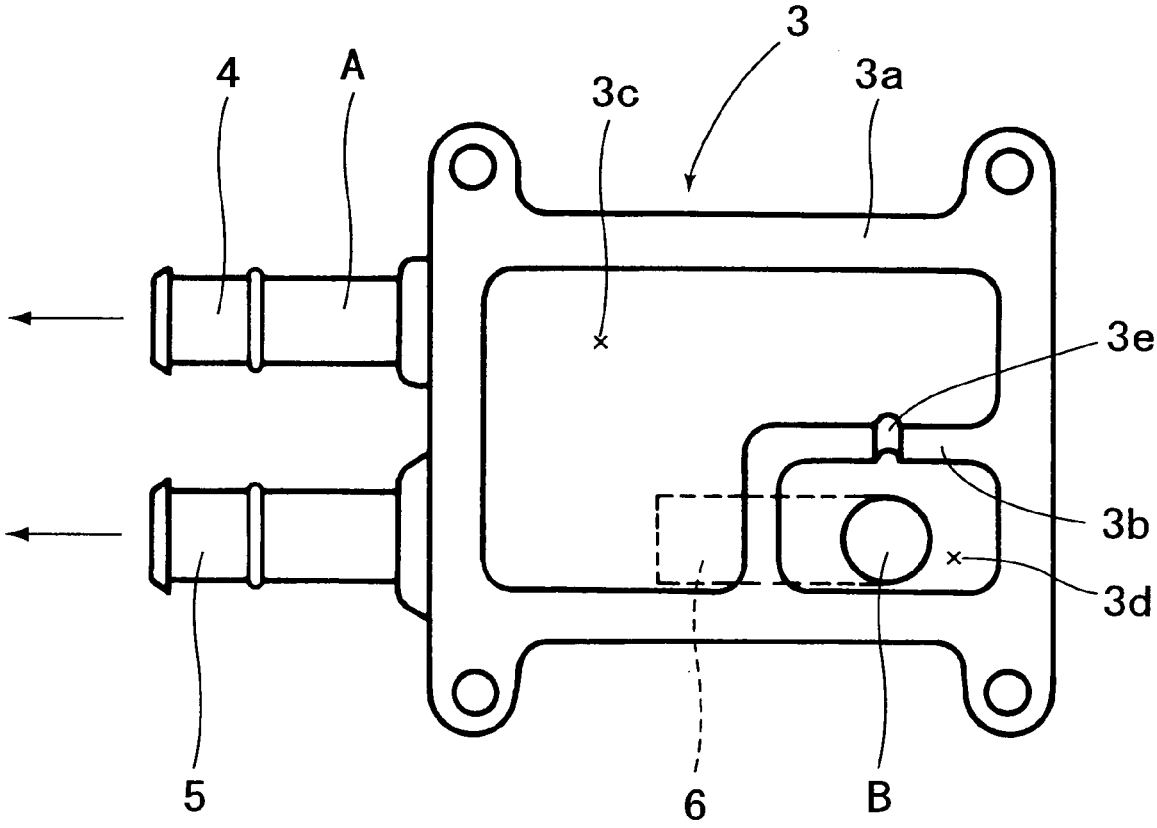
FIG. 3 is a front view of the water outlet from the cylinder head.

Referring to FIG. 1, FIG. 2 and FIG. 3, in the side surface of a cylinder head 1 constructing an internal combustion engine is provided an outlet 1*a* for coolant used to cool the interior of the internal combustion engine. Also, in the inside of the cylinder head 1 is formed a suction passage 1*b* to return the coolant into a water pump (coolant pumping means, not shown).

On the side surface of the cylinder head 1 is mounted a water outlet 3 (coolant distributing means) through a gasket 2 by means of bolts.

This water outlet (coolant distributing means) 3 has a mating surface 3*a* mating with the side surface of the cylinder head 1 through the gasket 2. In the interior of the water outlet 3 a feeding chamber 3*c* and a receiving chamber 3*d* are provided and respectively positioned above and below a partition 3*b* interposed therebetween. The upper portion of this receiving chamber 3*d* communicates with lower portion of the feeding chamber 3*c* through a notch 3*e* (bubble introducing means) formed vertically in a groove shape in the mating surface 3*a*.

Further, on the exterior wall of the water outlet 3 is provided a radiator connector 4 communicating with the inside of the feeding chamber 3*c* and forming the first path A. Although the radiator connector 4 in this embodiment is illustrated in the right side of the water outlet 3 for the sake of convenience to clarify the interior structure of the water outlet 3, the connector 4 may be provided either on the left side or on the top of the water outlet 3.

Also, on the exterior wall of the water outlet 3 is provided a heater connector 5 communicating with the inside feeding chamber 3*c*, and further on the rear side of the water outlet 3 is provided a heater return connector 6 communicating with the inside receiving chamber 3*d*.

The radiator connector 4 is to be connected to a hose communicating with a radiator (not shown). The coolant is supplied from the radiator connector 4 through this hose to the radiator (heat radiating means), in which the coolant is cooled and returned to a water pump (not shown). The radiator is provided with a cap, which constructs a bubble removing portion to discharge bubbles within the coolant outside.

The heater connector 5 is to be connected to a hose connected to a heater core (not shown). The coolant is supplied from the heater connector 5 through this hose to the heater core, from which the coolant is returned through a hose (not shown) to the heater return connector 6.

Namely, when a water pump (coolant pumping means, not shown) is operated on the condition that the water outlet 3 is fixedly mounted on the side of the cylinder head 1 with the intervention of the gasket 2, the coolant is supplied from the water pump into the cylinder head 1 and cylinder block to cool the inside thereof. After cooling the internal combustion engine, the coolant is introduced from the coolant outlet 1*a* of the cylinder head 1 into the feeding chamber 3*c* of the water outlet 3. Through the interior of the feeding chamber 3*c*, a part of the coolant is fed to the radiator connector 4 constructing the first path A into the radiator (heat radiating means). The coolant is cooled in the radiator and simultaneously the bubbles contained in the coolant are drawn out of the cap (bubble removing portion) of the radiator. After that, the coolant is returned into the water pump (coolant pumping means).

Also, another part of the coolant is fed from the feeding chamber 3*c* through the heater connector 5 into the heater core (not shown). The coolant is returned from the heater core through the heater return connector 6 into the receiving chamber 3*d* of the water outlet 3. Further, the coolant is returned from the receiving chamber 3*d* through the suction passage 1*b* formed inside the cylinder head 1 to the water pump (not shown).

As stated above, with regard to the coolant that is fed from the radiator connector through the first path A into the radiator (heat radiating means), the bubbles in the coolant are removed at the cap (bubble removing portion) of the radiator, and then the coolant is returned to the water pump. On the other hand, with regard to the coolant that is fed from the heater connector 5 into the heater core (not shown) and returned through the second path B (the return connector 6, receiving chamber 3*d* and suction passage 1*b*) into the water pump (not shown), if a part of the coolant is vaporized and bubbles are generated within the coolant, the coolant in case of the prior art may be returned into the water pump as containing the bubbles. However, in this embodiment, the bubbles within the coolant entered the receiving chamber 3*d* of the second path B float up through the notch (bubble introducing portion) 3*e* formed in the water outlet 3 into the feeding chamber 3*c*. Further, the bubbles are carried from the feeding chamber 3*c* through the first path A and removed out of the radiator cap. Accordingly, the bubbles are prevented from entering the water pump (coolant pumping means) without lowering its efficiency, so that the cooling performance of the cooling system may be improved.

Incidentally, in this embodiment the water outlet (coolant distributing means) 3 and the radiator with a cap (bubble removing portion, not shown) compose a coolant returning means.

As described above, due to a simple structure in which the interior of a water outlet 3 is divided into a feeding chamber 3*c* composing the first path A and a receiving chamber 3*d* composing the second path B and the receiving chamber 3*d* communicates with the feeding chamber 3*c* through a notch (bubble introducing portion) 3*e*, the bubbles contained in the coolant flowing through the second path B is well introduced through the notch 3*e* into the feeding chamber 3*c* of the first path A. Then, the bubbles may be removed from the coolant and discharged out of the radiator cap in the first path A.

Figure 4:
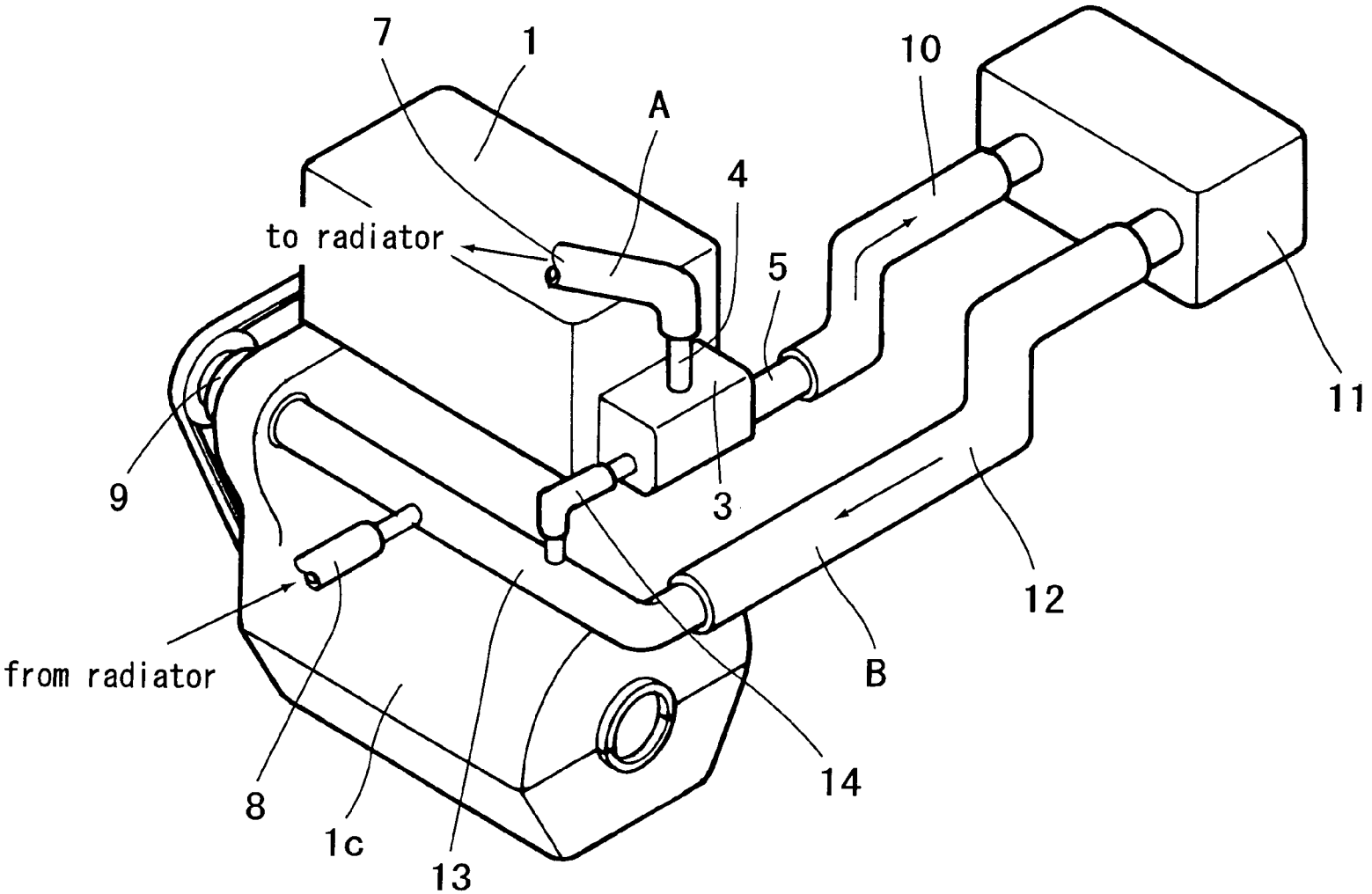
FIG. 4 is an outline perspective view of a cooling system mounted on an internal combustion engine, as another embodiment according to the present invention.

Now, referring to FIG. 4 showing a schematic perspective view of another embodiment, a water outlet 3 is fixedly mounted through a gasket on one side of a cylinder head 1 composing an internal combustion engine.

On the top of the water outlet 3 is provided a radiator connector 4, to which is connected a radiator passage 7 composing the first path A. Through the radiator passage 7 into a radiator (not shown) is fed a coolant, so that the bubbles in the coolant are drawn out at a cap (bubble removing portion, not shown) provided on the radiator. Then, the coolant is returned through a radiator return passage 8 composing the first path A into a water pump (coolant pumping means) 9.

Also, on one side of the water outlet 3 is provided a heater connector 5 connected to a heater passage 10 having one end connected to a heater core 11. From the heater core 11 is extended a heater return passage 12, which is connected to a suction passage 13, which is further connected to the water pump 9. The coolant from the heater core 11 is returned through the heater return passage 12 and suction passage 13, both of which compose the second path B, into the water pump 9.

In this embodiment, there is provided a bypass passage 14 (bubble introducing portion) that makes this suction passage 13 communicate with the inside of the water outlet 3. In the second path B, the bubbles contained in the coolant are carried through the heater return passage 12 into the suction passage 13, from which the bubbles are introduced through the bypass passage 14 into the water outlet 3. Then, the bubbles are carried through the radiator connector 4 into the radiator and removed at the radiator cap (bubble removing portion).

Accordingly, also in such a construction as the second embodiment, the bubbles in the coolant may be well removed by utilizing the cap (bubble removing portion) of the existing radiator (heat radiating means). Since no bubbles are transferred into the water pump 9, the efficiency of the water pump 9 is prevented from lowering and the cooling performance of the cooling system may be improved.

Having described the invention in detail and by reference to the preferred embodiment thereof, it will be apparent that other modifications and variations are possible without departing from the scope of the invention defined in the appended claims.

What is claimed is:

1. A cooling system for performing the cooling of an internal combustion engine by means of circulating coolant, comprising:

a coolant pumping means for pumping said coolant; and a coolant returning means for removing bubbles included in said coolant and for returning the coolant without bubbles to said coolant pumping means, wherein said coolant returning means comprises a first path for returning said coolant to said coolant pumping means through a bubble removing portion capable of removing the bubbles, and a second path for returning said coolant to said coolant pumping means not through said bubble removing portion; and in said second path is formed a bubble introducing portion capable of introducing said bubbles into said bubble removing portion through said first path.

2. A cooling system as defined in claim 1, wherein said coolant returning means is a means for removing bubbles contained in the coolant after cooling said internal combustion engine and for returning the coolant to said coolant pumping means.

3. A cooling system as defined in claim 1, wherein said coolant returning means has a coolant distributing means comprising a feeding chamber for feeding the coolant after cooling said internal combustion engine into said first path and said second path; and a receiving chamber provided as a part of said second path under said feeding chamber for receiving the coolant fed into said second path from said feeding chamber; and said bubble introducing portion is a means for making the upper portion of said receiving chamber communicate with said feeding chamber.

4. A cooling system as defined in claim 3, wherein said coolant distributing means has a mating surface with said internal combustion engine; said feeding and said receiving chamber are divided by a partition formed as a part of said mating surface; and said bubble introducing portion is a notch formed in said partition.

5. A cooling system as defined in claim 1, wherein said first path is provided with a heat radiating means for radiating the heat of said coolant; and said bubble removing portion is formed in said heat-radiating means.

6. An internal combustion engine provided with said cooing system as defined in claim 1.

* * * * *